US011667468B2

(12) United States Patent
Young

(10) Patent No.: US 11,667,468 B2
(45) Date of Patent: Jun. 6, 2023

(54) REFUSE CONTAINER LID OPENING DEVICE HAVING PUSHUP ACTUATOR

(71) Applicant: Daniel L. Young, San Anselmo, CA (US)

(72) Inventor: Daniel L. Young, San Anselmo, CA (US)

( * ) Notice: Subject to any disclaimer, the term of this patent is extended or adjusted under 35 U.S.C. 154(b) by 0 days.

(21) Appl. No.: 17/386,333

(22) Filed: Jul. 27, 2021

(65) Prior Publication Data

US 2022/0033179 A1 Feb. 3, 2022

Related U.S. Application Data

(60) Provisional application No. 63/058,453, filed on Jul. 29, 2020, provisional application No. 63/058,454, filed on Jul. 29, 2020.

(51) Int. Cl.

| | |
|---|---|
| ***B65F 1/16*** | (2006.01) |
| ***B65F 1/02*** | (2006.01) |
| ***B65F 1/14*** | (2006.01) |

(52) U.S. Cl.

CPC ..... *B65F 1/1623* (2013.01); *B65F 1/02* (2013.01); *B65F 1/1646* (2013.01); *B65F 1/1473* (2013.01); *B65F 2001/1653* (2013.01)

(58) Field of Classification Search

CPC ..... B65F 1/1623; B65F 1/02; B65F 1/1646; B65F 1/1473; B65F 2001/1653; B65F 1/16; B65F 1/1615; B65F 2001/1669; B65F 2001/1676; B65F 1/1421; B65F 1/163; B65D 43/16; B65D 43/24; B65D 43/262; B65D 43/26

USPC ..... 220/263

See application file for complete search history.

(56) References Cited

U.S. PATENT DOCUMENTS

| | | | | |
|---|---|---|---|---|
| 4,657,155 | A * | 4/1987 | Kendrick | B65D 43/26 217/60 B |
| 5,011,036 | A * | 4/1991 | Souza | B65F 1/163 220/908 |
| 8,146,767 | B1 * | 4/2012 | Grant | B65F 1/163 220/908 |
| 9,067,731 | B1 * | 6/2015 | Jackson | B65F 1/1623 |
| 2015/0353279 | A1 * | 12/2015 | Azhocar | B65F 1/1623 29/428 |
| 2019/0152696 | A1 * | 5/2019 | Wegner | B65F 1/0053 |
| 2020/0115157 | A1 * | 4/2020 | Dworkin | E05C 1/004 |

* cited by examiner

*Primary Examiner* — John K Fristoe, Jr.
*Assistant Examiner* — Laura E. Parker
(74) *Attorney, Agent, or Firm* — Brian Beverly; Beeson Skinner Beverly, LLP

(57) ABSTRACT

A refuse container lid opening device includes a lid hingedly attached to a container body for covering the container body's top opening. The lid when closed is flush with or recessed below the top edge of a railing extending around the top rim of the container body. An actuator retained in a sleeve on the outer surface of the container body is movable using a first hand between a rest position and an upraised position in which it is received in a slot in the top rim of the container body and engaged with the lid, further upward movement of the actuator opening the lid to form a manually accessible gap between the lid and the top rim to allow the lid to be fully opened using a second hand.

9 Claims, 6 Drawing Sheets

REFUSE CONTAINER LID OPENING DEVICE HAVING PUSHUP ACTUATOR

CROSS-REFERENCE TO RELATED APPLICATIONS

This application claims the benefit of U.S. Provisional Application No. 63/058,453 filed Jul. 29, 2020, and it claims the benefit of U.S. Provisional Application No. 63/058,454, filed Jul. 29, 2020.

BACKGROUND

Field of the Invention

This invention relates to a lidded waste container that is resistant to opening by wild animals such as raccoons, foxes, opossums, and the like.

Description of Related Art

Many attempts have been devised to address the common problem of wild animals gaining access to refuse containers stored outside. Raccoons are especially adept at learning how to open refuse container by cleverly making use of their dexterous paws. Prior art solutions vary from simple catches and snaps, to strapping down the container's lid using bungie cords, to sophisticated locking mechanisms. Many of these attempts assume that the container has one or more surfaces or edges that can be snagged or gripped by the paws of an animal and hope to lock the container closed despite a creature's ability to find a "paw" hold with which to pry the container open.

SUMMARY OF THE INVENTION

A container according to the invention comprises an open-topped container body and a lid pivotally attached to the rear side of the body. The container has an opening mechanism provided by a movable "push-up" actuator secured to the top of the outer front face of the body. The lid has a smooth flat top and no handles or grips such that, when the lid is closed, its outer edges are recessed below and fully concealed by a railing surrounding the top opening of the body. The push-up actuator thus provides the only opening mechanism for the lid.

Opening the lid requires two hands. One hand pushes up on the actuator, which lifts the front of the lid until a gap is formed between the front of the lid and the body. A second hand is then inserted into the gap where it can then lift the lid to a fully opened position. Wild animals are unable to use two hands to open the container in this manner.

The invention thus provides a lidded waste container that is resistant to opening by wild animals without requiring that additional safeguards be taken to secure the container such as by using a bungle cord, latch assembly or locking mechanism.

BRIEF DESCRIPTION OF THE DRAWINGS

Exemplary embodiments of the invention will now be described with reference to the accompanying drawings, in which.

DETAILED DESCRIPTION OF THE ILLUSTRATED EMBODIMENTS

Figure 1:
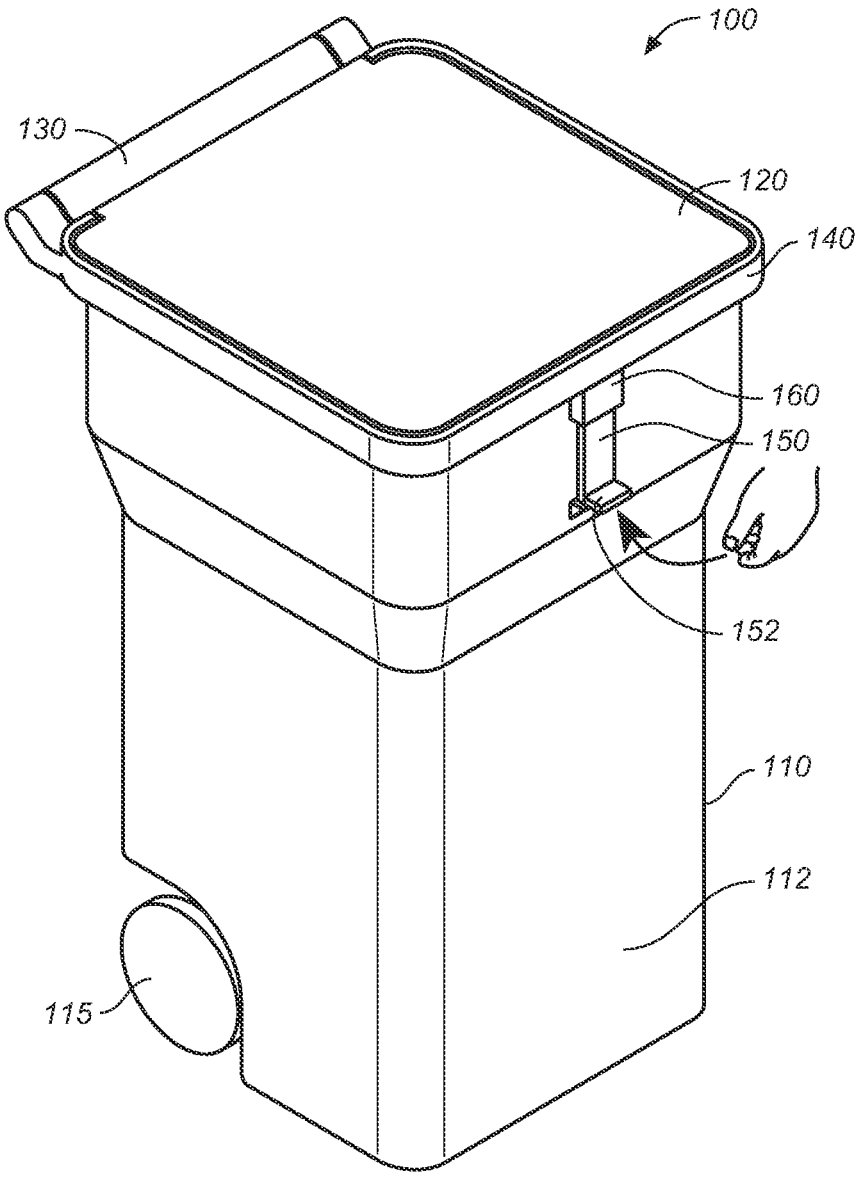
FIG. 1 is a perspective view of a refuse container lid opening device having a push-up actuator according to the invention showing the lid in a closed position.

An refuse container lid opening device having a push-up actuator according to the invention, indicated generally at 100 in FIG. 1, comprises an open-topped container body 110 and a lid 120 that is pivotally attached to the rear side of the body by a hinge 130. A moveable "push-up" actuator 150 provides an opening mechanism for the container 100 and in some embodiments may include wheels 115.

Figure 5:
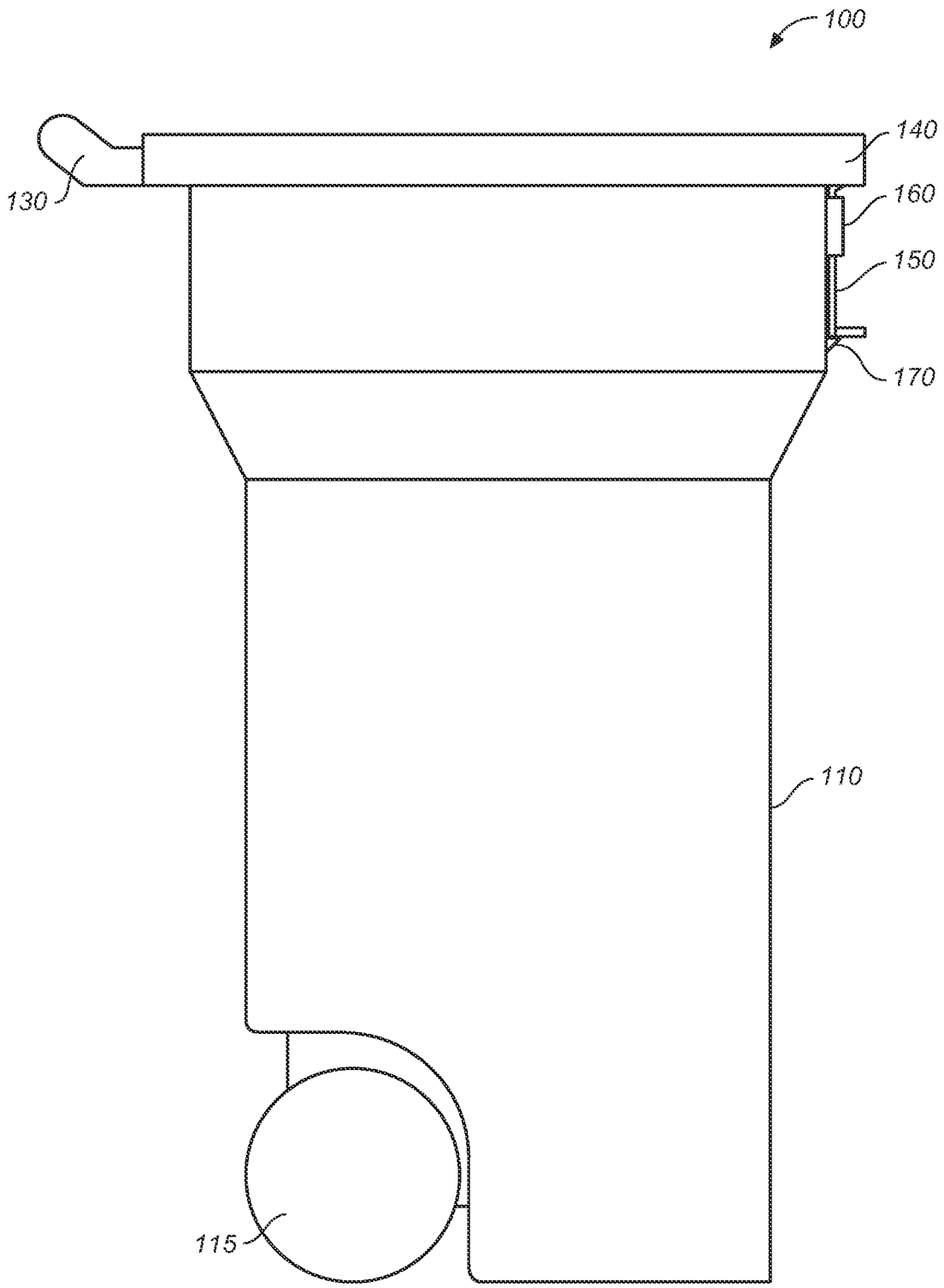
FIG. 5 is a side elevation view of the device showing the lid in the closed position.
Figure 6A:
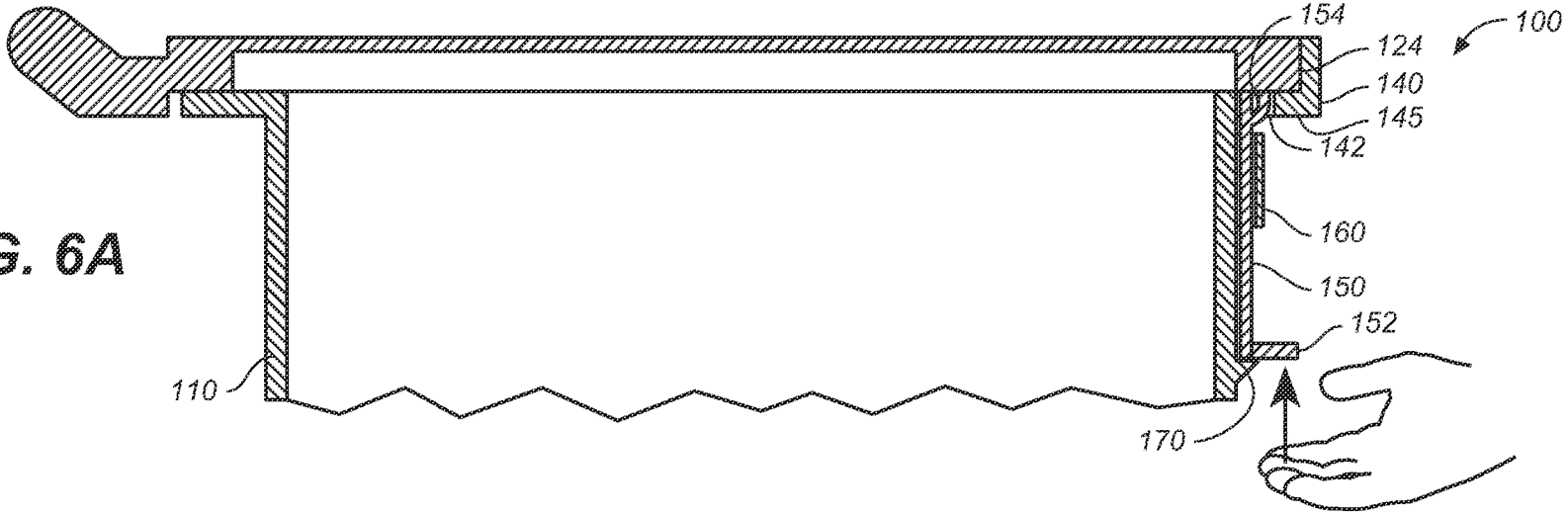
FIGS. 6A and 6B are enlarged, fragmentary sectional views of the device in the closed position and in a partially opened position, respectively.
Figure 6B:
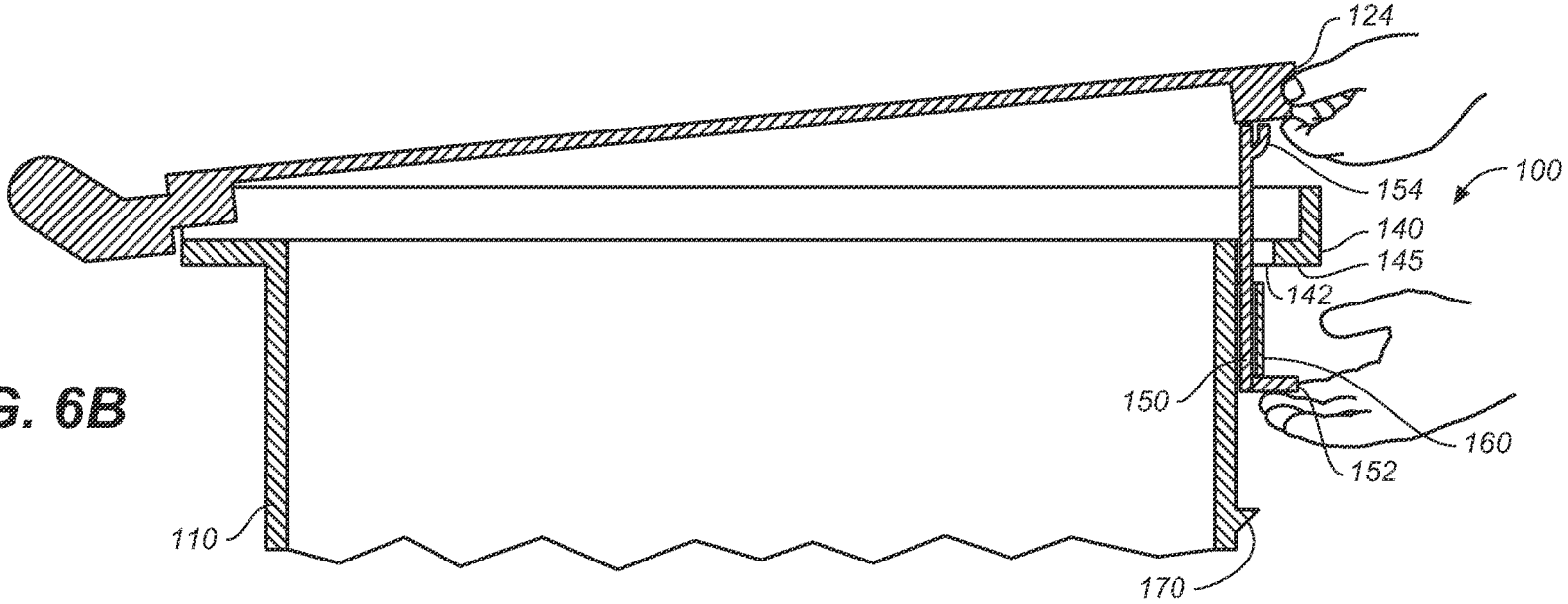

With additional reference to FIG. 5, it is seen that the push-up actuator 150 is flat and elongated, is oriented vertically along the top outer front face 112 of the container body 110 and is secured thereto by a combination retaining sleeve 160 and stop 170. A horizontal handle 152 that extends outwardly from the bottom end of the actuator 150. The handle 152 may be an integrally molded portion of the actuator 150 or it may be detachably or hingedly attached to the bottom portion of the actuator 150. The retaining sleeve 160 and stop 170 on the front face 112 of the container body 110 may be integrally molded with the body 110 or may be mounted or otherwise securely fastened to the container body 110.

Figure 2:
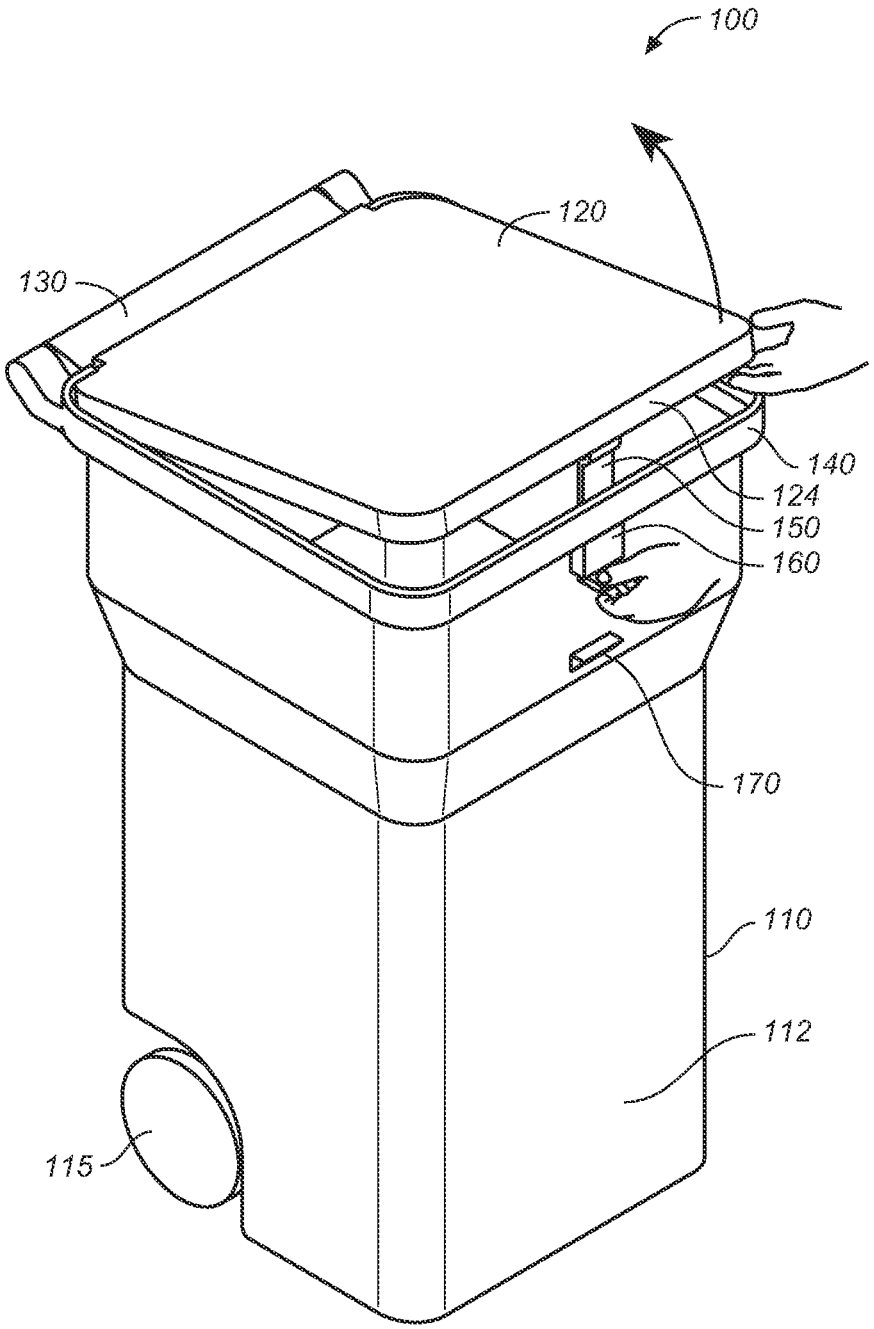
FIG. 2 is a perspective view thereof showing the lid in a partially opened position.
Figure 3:
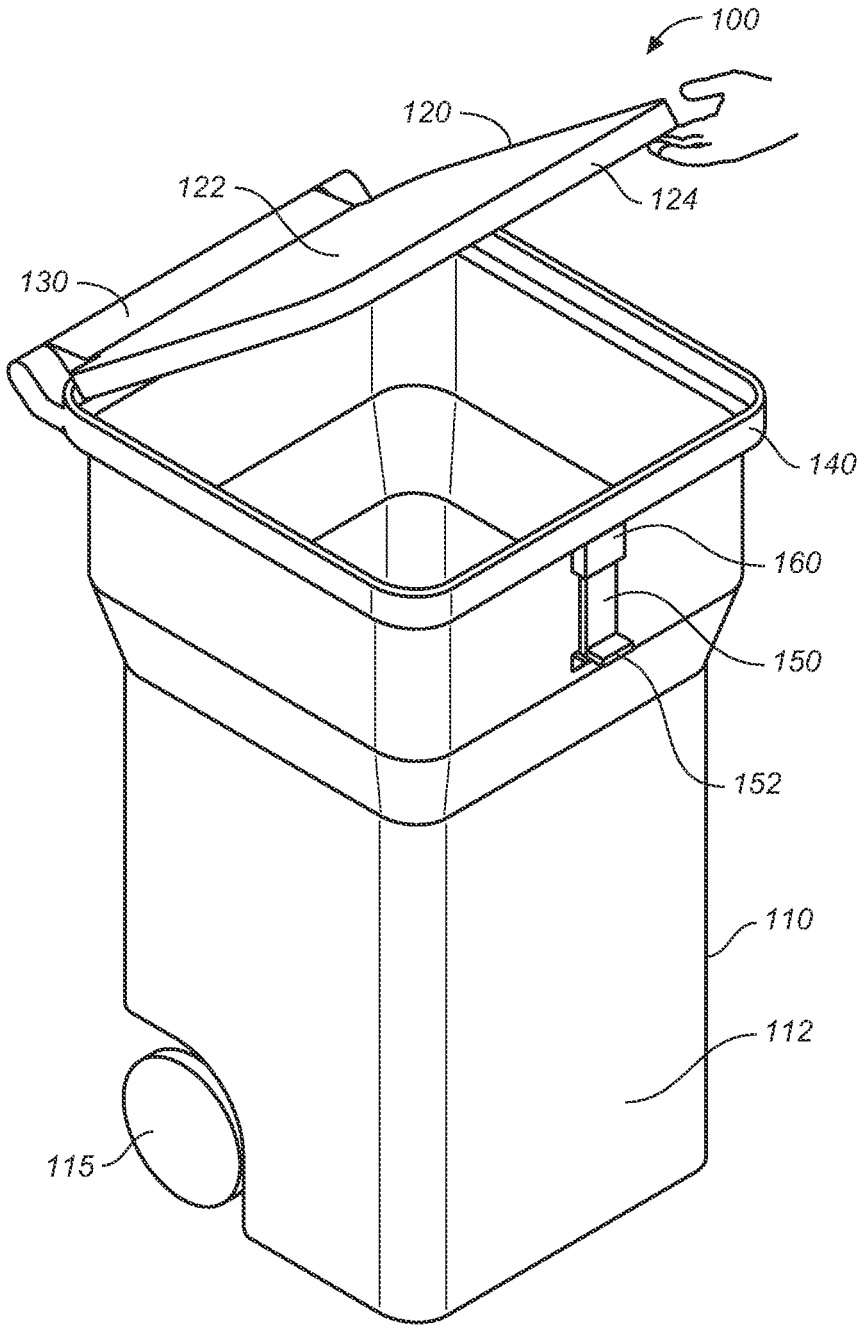
FIG. 3 is a perspective view thereof showing the lid in a fully opened position.
Figure 4:
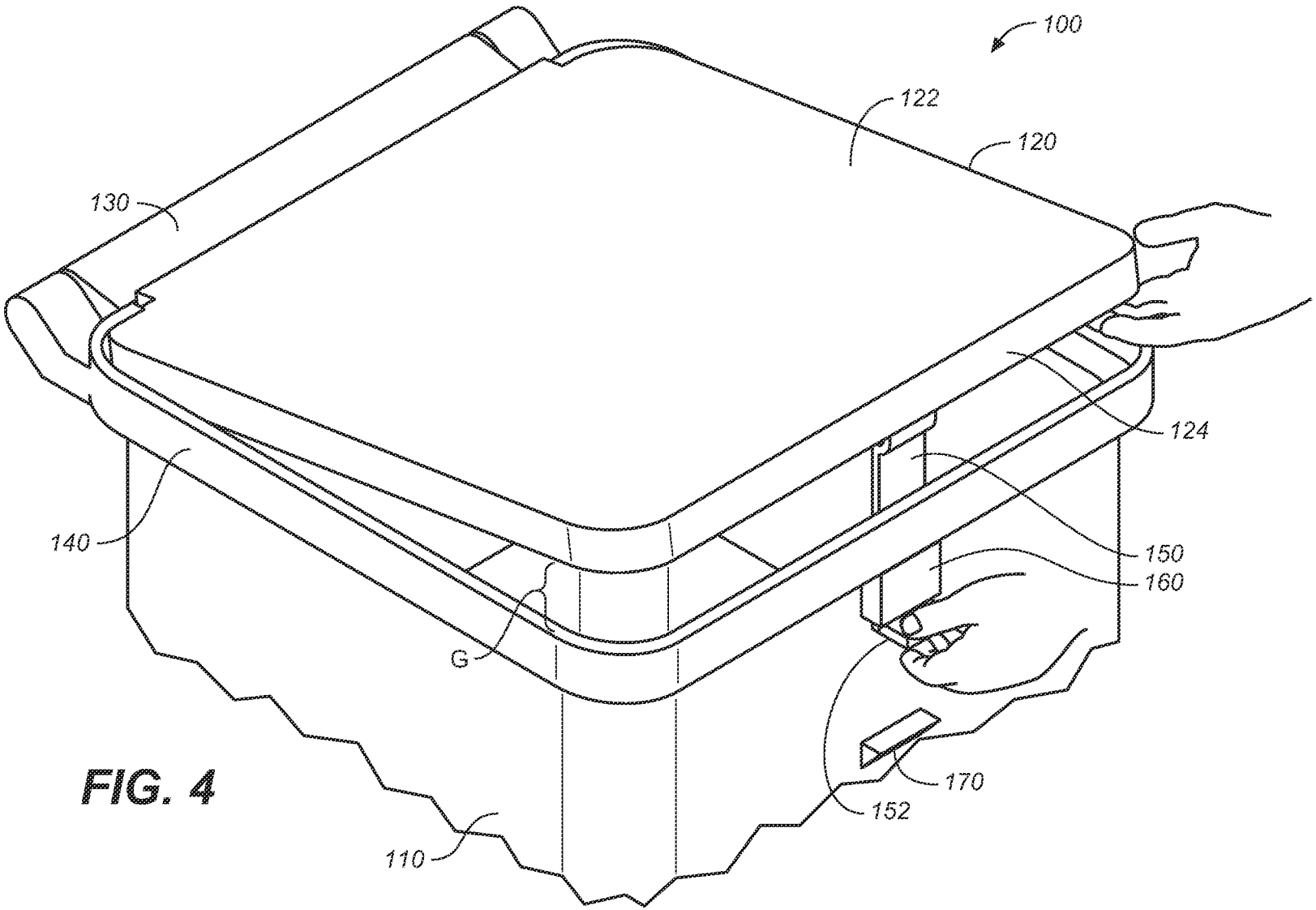
FIG. 4 is an enlarged, fragmentary perspective view thereof showing the lid being moved from a closed position to an open position.

As seen in FIGS. 1 and 5, when the container 100 is closed, the horizontal handle 152 of the actuator 150 rests on the stop 170. The actuator 150 is movably secured to the body 110 by the retaining sleeve 160 such that lifting or "pushing up" on the actuator 150 by the handle 152 as seen in FIG. 2 causes the actuator 150 to move up. Pushing up on the actuator 150 causes the top end of the actuator 150 to engage with the bottom of the outer edge 124 of the lid 120 thereby raising the front of the lid 120. Releasing the handle 152 as seen in FIG. 3 allows the actuator 150 to return to its original position with its handle 152 resting on the stop 170.

The lid 120 of the waste container 100 has a flat top surface 122 that has no handles or grips. In addition, a railing 140 that surrounds the top opening of the body 110 conceals the outer edges 124 of the lid 120 when the lid 120 is closed. The railing 140 extends vertically from a shelf 145 such that, when the lid 120 is closed, the flat top surface 122 of the lid 120 is flush with the top of the railing 140 so that the actuator 150 is the only viable mechanism for opening the lid 120. Since the outer edges 124 of the closed lid 120 are recessed below the railing 140, wild animals such as racoons cannot insert their paws under the lid 120 to open the container 100.

As shown in FIGS. 2-4, 6A and 6B, two hands are required to operate the push-up actuator 150 to open the lid 120 of the container 100. One hand is used to push up on the actuator 150 by lifting it by its handle 152 so that the top end 154 of the actuator lifts the front of the lid 120 by its outer front edge 124 until a gap G is formed between the lid 120 and the body 110. A second hand may then be inserted into the gap G to lift the lid 120 to a fully opened position.

The present invention thus provides a refuse container that is resistant to being opened by wild animals thereby avoiding the need to secure the lid with bungie cords, latch assemblies or other locking mechanisms, that is otherwise easy to open by human users, and that will still fall open when overturned for trash collection. The invention advantageously hides edges or surfaces which can easily be gripped by an animal and capitalizes on the need for two hands to open the container.

Certain embodiments of an animal-resistant refuse container lid opening device having a push-up actuator have thus been described and illustrated herein in detail. These embodiments are merely exemplary implementations of the invention and are not intended to limit the scope of the invention to their particular details. Alternative embodiments of the invention not expressly disclosed herein will be evident to persons of ordinary skill in the art. For example, the invention can be embodied in other types of storage containers that need to be animal resistant, such as the outdoor food storage lockers commonly found at camping grounds.

I claim:

1. A refuse container lid opening device comprising:

a container body having a front surface, a rear surface opposite the front surface, and a top rim, the front surface including a retaining sleeve, the top rim defining a top opening to the container body and having an outwardly extending horizontal support flange, the support flange including a slot, a lid hingedly attached above the rear surface to the container body for covering the top opening, the lid having a front portion, an actuator movably retained in said sleeve, said actuator having a top end, and a partly open configuration in which the actuator is received in the slot of the support flange of the top rim, the top end of the actuator is engaged with the front portion of the lid, and the lid is raised above the top rim of the container body thereby forming a manually accessible gap between the container body and the lid.

2. The refuse container lid opening device of claim 1 further comprising:

the outer surface of the container body having a stop, the actuator having a bottom end, the actuator movable in said sleeve between a resting configuration and an engaged configuration, in said resting configuration the bottom end of the actuator resting on the stop, in said engaged configuration the actuator upraised from its position in the resting configuration and the top end of the actuator is engaged with the lid, and in the partly open configuration, the actuator being raised above its position in the engaged configuration.

3. The refuse container lid opening device of claim 2 further comprising:

a closed configuration in which the actuator is movable between said resting and engaged configurations.

4. The refuse container lid opening device of claim 2 further comprising:

the sleeve forming a channel in which the actuator moves and the sleeve having a top, the top end of the actuator having an enlarged shoulder having a dimension larger than the channel, and in the resting configuration the shoulder resting on the top of the sleeve, such that further downward motion of the actuator is limited by the sleeve.

5. The refuse container lid opening device of claim 1 further comprising:

the top rim of the container body including a circumferential railing extending upwardly from the support flange, the railing having a top edge, the lid having a top surface including a perimeter edge, and a closed configuration in which the top surface of the lid is flush with or recessed below the top edge of said railing.

6. The refuse container lid opening device of claim 1 further comprising:

the lid having a smooth top surface free of grabbable handles or protuberances.

7. The refuse container lid opening device of claim 1 further comprising:

the actuator having a bottom end including an outwardly extending handle.

8. A refuse container lid opening device comprising:

a container body having a top rim defining a top opening to the container body, a front surface and a rear surface opposite the front surface, the front surface including a retaining sleeve and a stop, the top rim having an outwardly extending horizontal support flange, the support flange including a slot, a lid hingedly attached to the rear surface of the container body for covering the top opening, the lid having a front portion, an actuator movably retained in said sleeve, said actuator having a top end and a bottom end, the actuator movable in said sleeve between a resting configuration and an engaged configuration, in said resting configuration the bottom end of the actuator resting on the stop, in said engaged configuration the actuator upraised from its position in the resting configuration and the top end of the actuator engaged with the lid, and a partly open configuration in which the actuator is raised above its position in the engaged configuration and is received in the slot of the support flange of the top rim, the top end of the actuator is engaged with the front portion of the lid, and the lid is raised above the top rim of the container body thereby forming a manually accessible gap between the container body and the lid.

9. A refuse container lid opening device comprising:

a container body having a front surface, a rear surface opposite the front surface, and a top rim, the front surface including a retaining sleeve and a stop, the top rim defining a top opening to the container body and having an outwardly extending horizontal support flange a slot and an upwardly extending circumferential railing, the support flange including a slot, the circumferential railing having a top edge, a lid hingedly attached to the container body for covering the top opening, the lid having a smooth top surface free of grabbable handles or protuberances, the top surface including a perimeter edge, an actuator movably retained in said sleeve, said actuator having a top end and a bottom end, the actuator movable in said sleeve between a resting configuration and an engaged configuration, in said resting configuration the bottom end of the actuator resting on the stop, in said engaged configuration the actuator upraised from its position in the resting configuration and the top end of the actuator is engaged with the lid, a closed configuration in which the top surface of the lid is flush with or recessed below the top edge of said railing and in which the actuator is movable between said resting and engaged configurations, and a partly open configuration in which the actuator is raised above its position in the engaged configuration, is received in the slot of the support flange of the rim and engaged with the lid, and in which the lid is raised above the top rim of the container body thereby forming a manually accessible gap between the container body and the lid.

* * * * *